US008330657B2

(12) United States Patent
Liu

(10) Patent No.: US 8,330,657 B2
(45) Date of Patent: Dec. 11, 2012

(54) ANTENNA AND PORTABLE WIRELESS COMMUNICATION DEVICE USING THE SAME

(75) Inventor: Chien-Chang Liu, Tu-Cheng (TW)

(73) Assignee: Chi Mei Communications Systems, Inc., Tu-Cheng, New Taipei (TW)

( * ) Notice: Subject to any disclaimer, the term of this patent is extended or adjusted under 35 U.S.C. 154(b) by 391 days.

(21) Appl. No.: 12/627,056

(22) Filed: Nov. 30, 2009

(65) Prior Publication Data

US 2011/0050532 A1 Mar. 3, 2011

(30) Foreign Application Priority Data

Aug. 28, 2009 (CN) ..... 2009 1 0306263

(51) Int. Cl.
*H01Q 1/24* (2006.01)

(52) U.S. Cl. ..... 343/702; 34/702; 34/700 MS

(58) Field of Classification Search ..... 343/700 MS, 343/702
See application file for complete search history.

(56) References Cited

U.S. PATENT DOCUMENTS

| | | | | |
|---|---|---|---|---|
| 6,255,994 | B1 * | 7/2001 | Saito | 343/700 MS |
| 6,753,815 | B2 * | 6/2004 | Okubora et al. | 343/700 MS |
| 7,619,569 | B2 * | 11/2009 | Wu et al. | 343/700 MS |
| 2005/0012668 | A1 * | 1/2005 | Hsu | 343/700 MS |

* cited by examiner

*Primary Examiner* — Dieu H Duong
(74) *Attorney, Agent, or Firm* — Altis Law Group, Inc.

(57) ABSTRACT

A portable wireless communication device includes a base circuit board, an antenna, and a switch. The base circuit board is a printed circuit board including a feed point and a ground point. The antenna is disposed on the base circuit board including a radiating portion, a feed portion, and a plurality of ground portions. The feed portion electrically connected to the feed point. The switch is electrically connected between the ground point and the plurality of ground portions to choose one ground portion to electrically connect to the ground point and obtain wide working frequency bands.

16 Claims, 6 Drawing Sheets

ANTENNA AND PORTABLE WIRELESS COMMUNICATION DEVICE USING THE SAME

BACKGROUND

1. Technical Field

The disclosure generally relates to antennas, particularly to a wideband antenna and a portable wireless communication device using the wideband antenna.

2. Description of Related Art

Most portable electronic devices have antennas for receiving/sending wireless signals. Commonly, a portable electronic device may receive/send wireless signals of different frequency bands, which requires its antenna be a wideband antenna.

However, many wideband antennas have complicated structures and large sizes, making it difficult to miniaturize portable electronic devices. Even if some miniaturized antennas can be installed in the portable electronic devices, precise installation is difficult Therefore, there is room for improvement within the art.

BRIEF DESCRIPTION OF THE DRAWINGS

Many aspects of the antenna and portable wireless communication device can be better understood with reference to the following drawings. The components in the drawings are not necessarily drawn to scale, the emphasis instead being placed upon clearly illustrating the principles of the antenna and the portable wireless communication device.

DETAILED DESCRIPTION

Figure 1:
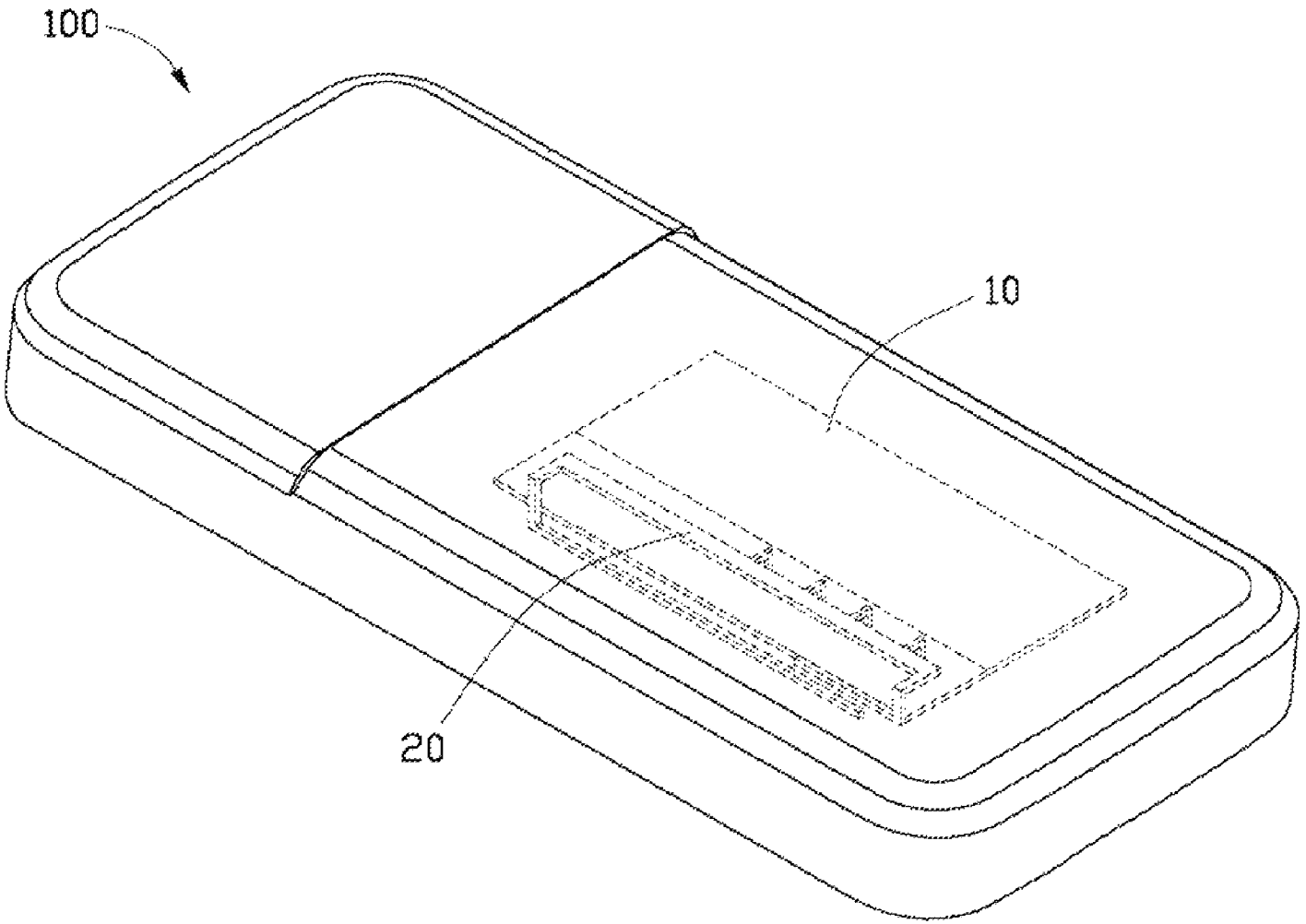
FIG. 1 is a schematic view of a portable wireless communication device, according to an exemplary embodiment.
Figure 2:
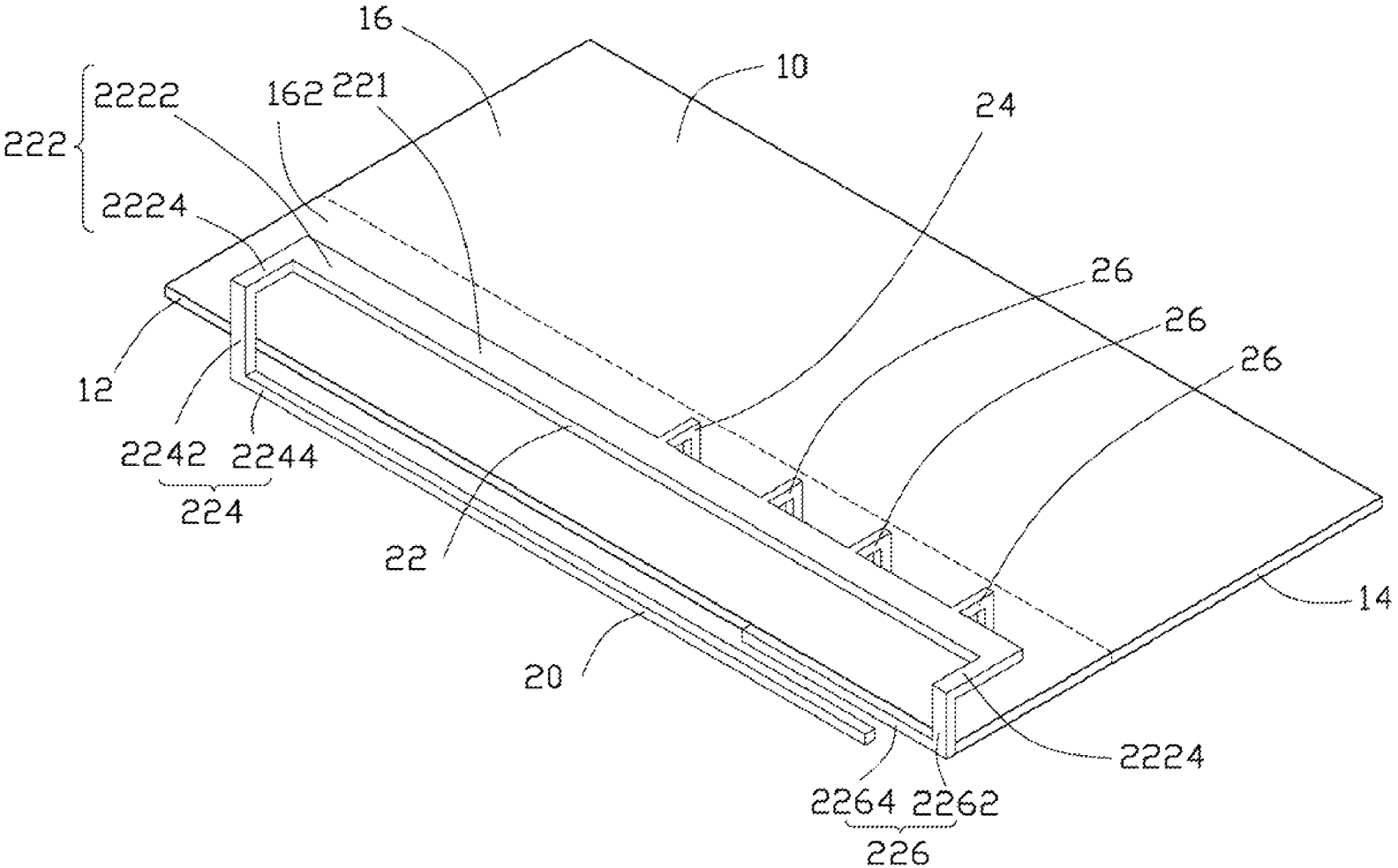
FIG. 2 is a schematic view of an antenna mounted on a base circuit board of the portable wireless communication device of FIG. 1.
Figure 3:
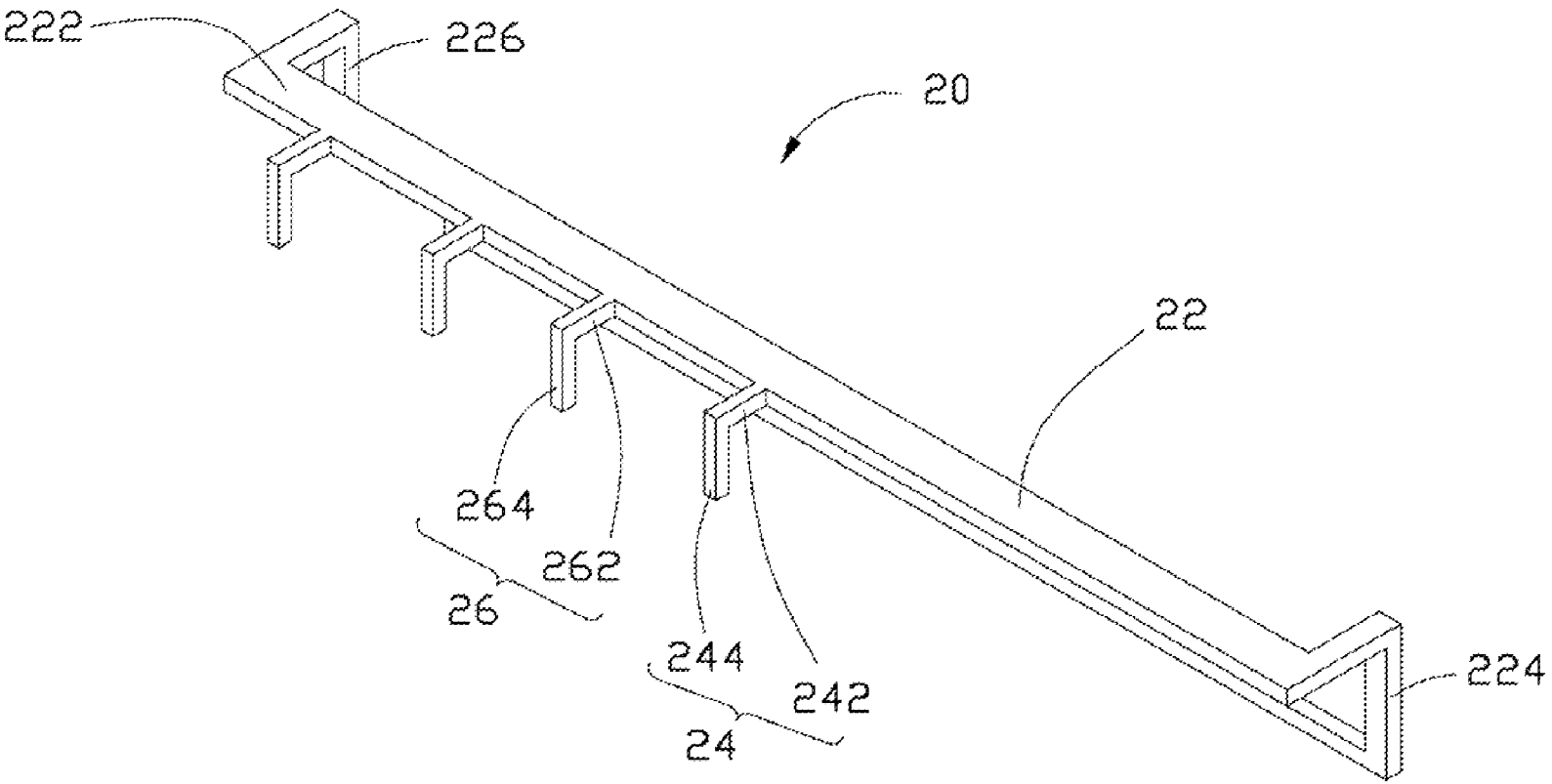
FIG. 3 is similar to FIG. 2, but shown from another angle.
Figure 4:
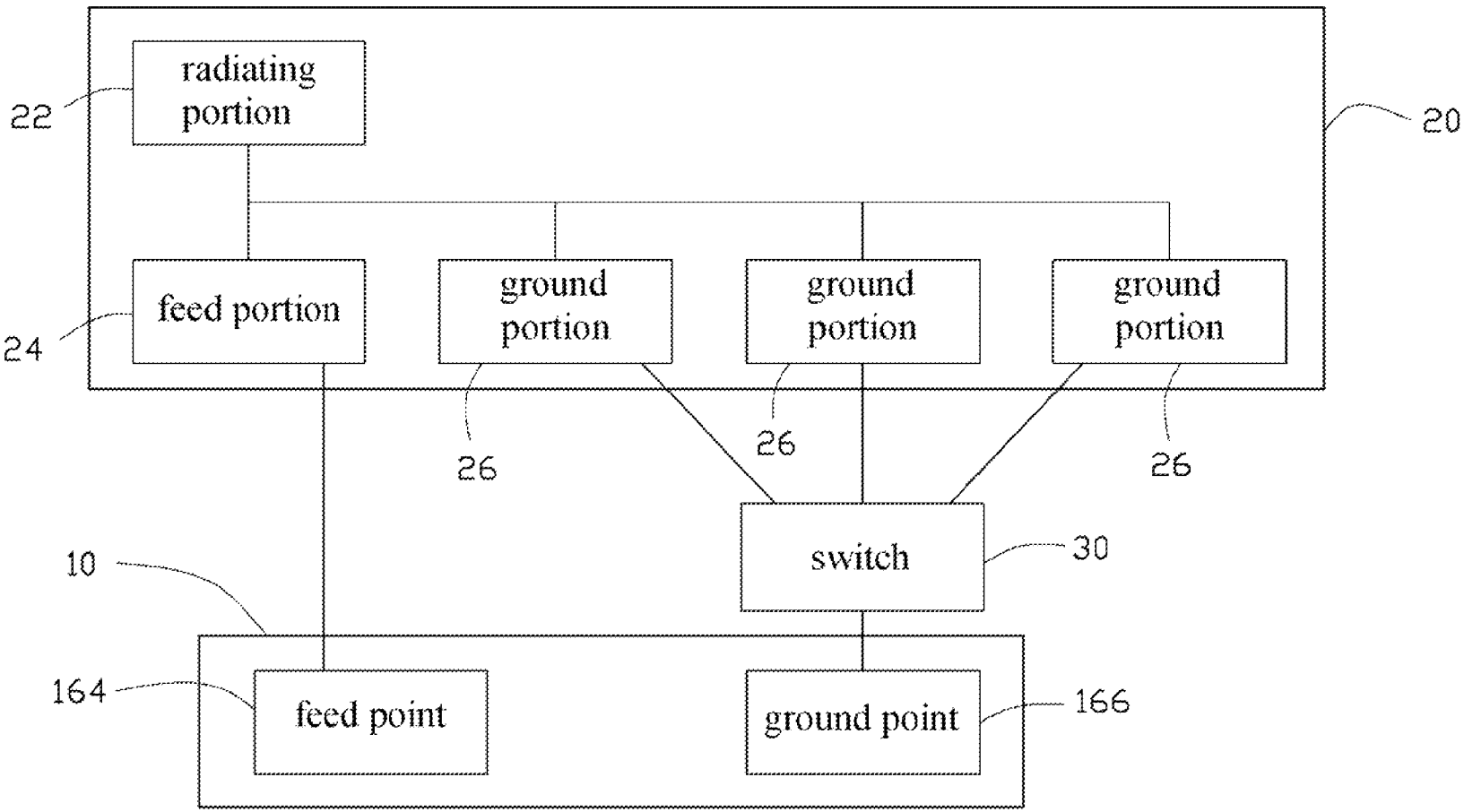
FIG. 4 is a block diagram of the antenna, the base circuit board, and a switch of the portable wireless communication device of FIG. 1.

Referring to FIGS. 1-4, a portable wireless communication device 100, such as a mobile phone or personal digital assistant, of an exemplary embodiment, includes an antenna 20 and a switch 30 both disposed on the base circuit board 10.

The base circuit board 10 is a printed circuit board (PCB) including a first side surface 12, a second side surface 14, and a top surface 16. An area 162 with no conductive members disposed thereon is defined on the top surface 16 near the first side surface 12 to mount the antenna 20, and avoid interference from other members or circuits of the portable wireless communication device 100 such as a camera, a speaker, etc. A feed point 164 and a ground point 166 (both schematically shown) are disposed on the top surface 16 to connect to the antenna 20.

The antenna 20 includes a radiating portion 22, a feed portion 24, and a plurality of ground portions 26 connected to the radiating portion 22. The radiating portion 22 includes a first radiating body 222, a second radiating body 224, and a third radiating body 226, an end of the second radiating body 224 and an end of the third radiating body 226 are connected to the first radiating body 222. The first radiating body 222 includes a first band section 2222 and two shorter second band sections 2224. The first band section 2222 can be a strip-shaped sheet. One end of each of the second band sections 2224 is perpendicularly connected to one of the ends of the first band section 2222 at one side thereof. The two second band sections 2224 are parallel to each other. The other ends of the two second band sections 2224 opposite to the first band section 2222 are perpendicularly connected to the second radiating body 224 and the third radiating body 226, respectively.

The second radiating body 224 is an L-shaped sheet including a first portion 2242 and a first arm portion 2244 perpendicularly connected to the first portion 2242. The second radiating body 224 is perpendicular to the first radiating body 222 with the first portion 2242 perpendicularly connected to one end of one second band section 2224.

The third radiating body 226 is also an L-shaped sheet including a second portion 2262 and a second arm portion 2264 perpendicularly connected to the second portion 2262. The third radiating body 226 is coplanar with the second radiating body 224, and perpendicular to the first radiating body 222. The second portion 2262 is perpendicularly connected to one end of the other second band section 2224, and parallel to the first portion 2242. The second arm portion 2264 is parallel to the first arm portion 2244.

The feed portion 24 is an L-shaped sheet including a first connecting end 242 and a feed end 244 perpendicular to one end of the first connecting end 242. The first connecting end 242 is perpendicularly connected to one side of the first band section 2222 opposite to the second radiating body 224 and the third radiating body 226. In the exemplary embodiment, there are three ground portions 26. Each ground portion 26 is similar to the feed portion 24 and includes a second connecting end 262 and a ground end 264. The three ground portions 26 are perpendicularly connected to one side of the first band section 2222, and are aligned with the feed portion 24. The second connecting ends 262 and the first connecting end 242 are in parallel and coplanar. The three ground ends 264 and the feed end 244 are in parallel and coplanar.

The switch 30 is electrically connected between the three ground portions 26 and the ground point 166. The switch 30 is used to automatically connect a selected one of the three ground portions 26 to the ground point 164 to obtain a corresponding working frequency of the antenna 20 via a controlling module such as a central processing unit (CPU) in the portable wireless communication device.

During assembly, the second arm portion 2264 of the antenna 20 is mounted on the first side surface 12 of the base circuit board 10, and the first radiating body 22, the feed portion 24 and the ground portion 26 are above the top surface 16 of the base circuit board 10. The switch 30 is electrically connected between the three ground portions 26 and the ground point 164. The feed portion 24 is electrically connected to the feed point 164.

Figure 5:
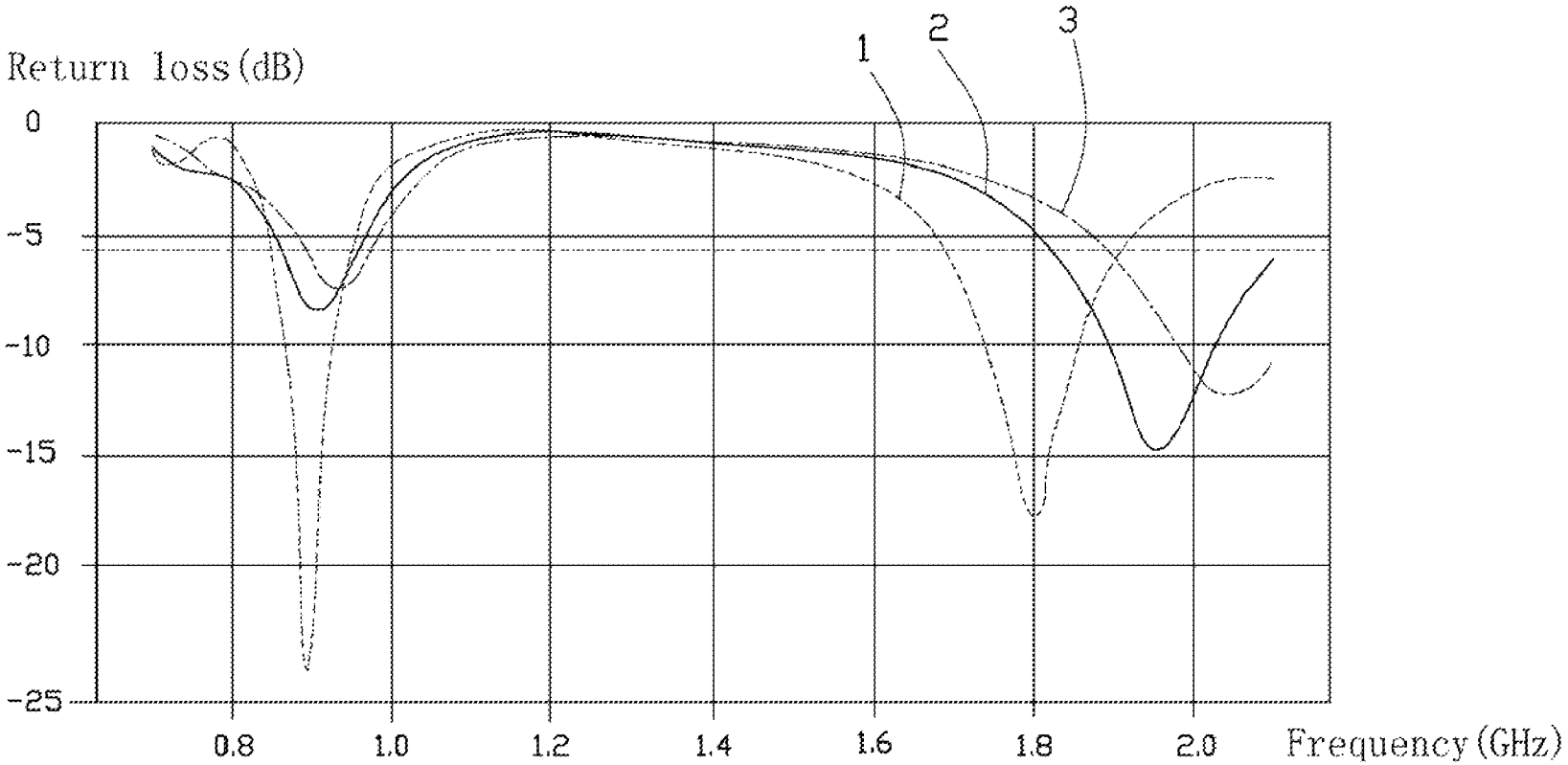
FIG. 5 is a test graph obtained for the antenna of FIG. 1, disclosing return loss varying with frequency when a ground point of the base circuit board is electrically connected to each ground portion of the portable wireless communication device of FIG. 1 in turn.
Figure 6:
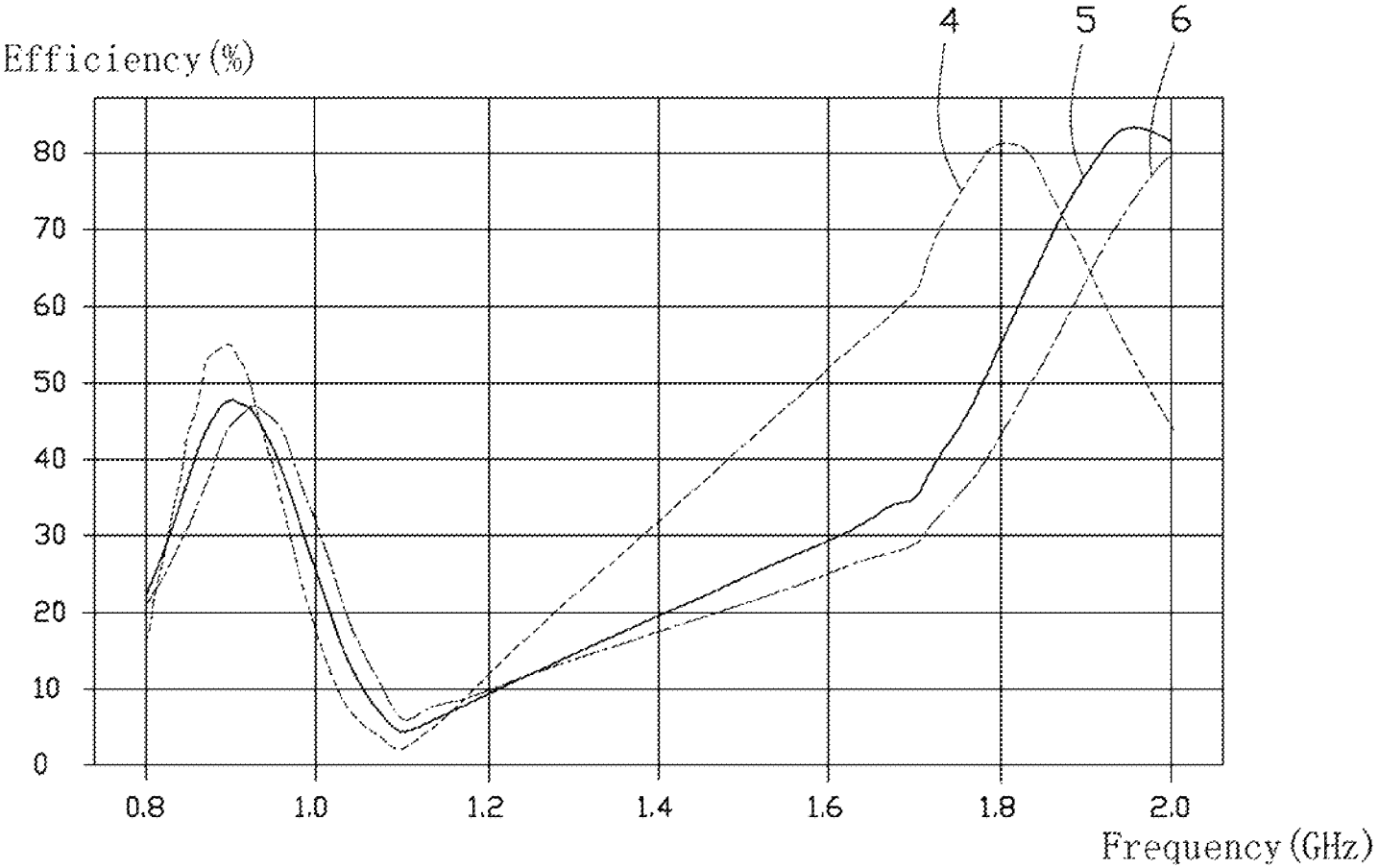
FIG. 6 is a test graph obtained for the antenna of FIG. 1, disclosing efficiency varying with frequency when a ground point of the base circuit board is electrically connected to each ground portion of the portable wireless communication device of FIG. 1 in turn.

Referring to FIGS. 5-6, curves 1~3 and curves 4~6 respectively shows return loss and efficiency varying with frequency of the antenna 20 when the ground point 166 connects a selected one of the ground portion 26. When the switch 30 is used to electrically connect the ground portion 26 adjacent to the feed portion 24 to the ground point 166, the electrical length of the antenna 20 makes the center working frequencies of the antenna 20 about 0.9 GHz and 1.8 GHz (Curves 1 and 4). When the switch 30 is used to electrically connect the middle ground portion 26 to the ground point 166, the electrical length of the antenna 20 makes the center working frequencies of the antenna 20 about 0.925 GHz and 1.95 GHz (Curves 2 and 5). When the switch 30 is used to electrically connect the last ground portion 26 to the ground point 166, the electrical length of the antenna 20 makes the center working frequencies of the antenna 20 about 0.95 GHz and 2.05 GHz (Curves 3 and 6). Therefore, the antenna 20 can work within a first working frequency band between about 0.9 GHz and 0.95 GHz and a second higher working frequency band between about 1.7 GHz and 2.1 GHz.

In other embodiments, the number of the ground portions 26 or the width between the ground portions 26 and the feed portion 24 also can be changed to adjust the working frequency bands of the antenna 20 since the working frequency is dependent on the electrical length thereof.

The antenna 20 obtains a plurality of working frequencies by selecting one of the plurality of the ground portions 26 to be active, and the available working frequency bands of the antenna 20, while occupying relatively much less space within the portable wireless communication device 100.

It is believed that the exemplary embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A portable wireless communication device, comprising:

a base circuit board including a feed point and a ground point;

an antenna disposed on the base circuit board, the antenna comprising:

a radiating portion, the radiating portion including:

a substantially U-shaped first radiating body, the legs defining the U-shape lying in a first radiating plane;

a substantially L-shaped second radiating body, the legs defining the L-shape lying in a second radiating plane; and a substantially L-shaped third radiating body, the legs defining the L-shape lying in a third radiating plane;

wherein an end of the second radiating body and an end of the third radiating body being connected to the opposite legs forming the U-shape of the first radiating body, the first radiating plane substantially perpendicular to the second and third radiating planes;

a feed portion electrically connected to the feed point;

a plurality of ground portions; and a switch disposed on the base circuit board, and electrically connected between the ground point and the plurality of ground portions to selectively connect one of the ground portions to the ground point to selectively obtain different working frequency bands.

2. The portable wireless communication device as claimed in claim 1, wherein the first radiating body includes a first band section and two second band sections perpendicularly connected to two ends of the first band section, the two second band sections are connected to the second radiating body and the third radiating body, respectively.

3. The portable wireless communication device as claimed in claim 2, wherein the second radiating body includes a first portion and a first arm portion perpendicularly connected to the first portion, the second radiating body is perpendicular to the first radiating body with the first portion connected to one end of one second band section.

4. The portable wireless communication device as claimed in claim 3, wherein the third radiating body includes a second portion and a second arm portion perpendicularly connected to the second portion, the second portion is perpendicularly connected to one end of another second band section.

5. The antenna as claimed in claim 4, wherein the second radiating plane is coplanar with the third radiating plane, the first portion is parallel to the second portion, the first arm portion is parallel to the second arm portion, and spaced from the second arm portion.

6. The antenna as claimed in claim 5, wherein lengths of the first portion and the first arm are longer than those of the second portion and the second arm.

7. The portable wireless communication device as claimed in claim 1, wherein the feed portion is a substantially L-shaped sheet including includes a first connecting end and a feed end perpendicularly extended from one end of the first connecting end, the first connecting end is connected to one side of the first radiating body opposite to the second radiating body and the third radiating body, the feed end is electrically connected to the feed point.

8. The portable wireless communication device as claimed in claim 7, wherein the ground portion is similar to the feed portion, and includes a second connecting end and a ground end perpendicularly extended from one end of the second connecting end, the plurality of the ground portions are perpendicularly connected to the one side of the first radiating body, and aligned with the feed portion.

9. The portable wireless communication device as claimed in claim 8, wherein there are three ground portions, when the switch is electrically connected to select the ground portion adjacent to the feed portion to be connected to the ground point, the electrical length of the antenna makes the center working frequencies of the antenna about 0.9 GHz and 1.8 GHz; when the switch is electrically connected to select the middle ground portion to be connected to the ground point, the electrical length of the antenna makes the center working frequencies of the antenna about 0.925 GHz and 1.95 GHz; and when the switch is electrically connected to select the last ground portion to be connected to the ground point, the electrical length of the antenna makes the center working frequencies of the antenna about 0.95 GHz and 2.05 GHz.

10. The portable wireless communication device as claimed in claim 1, wherein the base circuit board further defines a rectangular area with no conductive members disposed thereon to mount the antenna.

11. An antenna used to a portable wireless communication device, comprising:

a radiating portion, the radiating portion including:

a substantially U-shaped first radiating body, the legs defining the U-shape lying in a first radiating plane;

a substantially L-shaped second radiating body, the legs defining the L-shape lying in a second radiating plane; and a substantially L-shaped third radiating body, the legs defining the L-shape lying in a third radiating plane;

wherein an end of the second radiating body and an end of the third radiating body being connected to the opposite legs forming the U-shape of the first radiating body, the first radiating plane substantially perpendicular to the second and third radiating planes;

a feed portion connected to the radiating portion, and used to connected to a feed point in the portable wireless communication device; and a plurality of ground portions connected to the radiating portion used to be selectively connected to a ground point in the portable wireless communication device, and obtain wide working frequency bands.

12. The antenna as claimed in claim 11, wherein the first radiating body includes a first band section and two second band sections perpendicularly connected to two ends of the first band section, the two second band sections are connected to the second radiating body and the third radiating, respectively.

13. The antenna as claimed in claim 12, wherein the second radiating body includes a first portion and a first arm portion perpendicularly connected to the first portion, the second radiating body is perpendicular to the first radiating body with the first portion connected to one end of one second band section.

14. The antenna as claimed in claim 13, wherein the third radiating body includes a second portion and a second arm portion perpendicularly connected to the second portion, the second portion is perpendicularly connected to one end of another second band section.

15. The antenna as claimed in claim 11, wherein the feed portion is a substantially L-shaped sheet including a first connecting end and a feed end from one end of the first connecting end, the first connecting end is connected to one side of the first radiating body opposite to the second radiating body and the third radiating body, the feed end is electrically connected to the feed point.

16. The antenna as claimed in claim 15, wherein the ground portion is similar to the feed portion including a second connecting end and a ground end from one end of the second connecting end, the plurality of the ground portions are perpendicularly connected to the one side of the first radiating body, and aligned with the feed portion.

* * * * *

UNITED STATES PATENT AND TRADEMARK OFFICE

CERTIFICATE OF CORRECTION

PATENT NO. : 8,330,657 B2
APPLICATION NO. : 12/627056
DATED : December 11, 2012
INVENTOR(S) : Chien-Chang Liu It is certified that error appears in the above-identified patent and that said Letters Patent is hereby corrected as shown below:

On the Title Page

Please replace Item (73) regarding "Assignees" with the following:

(73) Assignees: Chi Mei Communication Systems, Inc., Tu-Cheng, New Taipei (TW).

Signed and Sealed this
Twenty-sixth Day of November, 2013

Margaret A. Focarino

Margaret A. Focarino
*Commissioner for Patents of the United States Patent and Trademark Office*